United States Patent [19]

Wharton

[11] Patent Number: 4,948,132

[45] Date of Patent: Aug. 14, 1990

[54] GOLF CLUB

[76] Inventor: Norman W. Wharton, Nunnery Lodge, Euston Road, Thetford, Norfolk IP24 2QB, United Kingdom

[21] Appl. No.: 310,475

[22] Filed: Feb. 13, 1989

Related U.S. Application Data

[63] Continuation of Ser. No. 70,077, Jul. 6, 1987, abandoned.

[30] Foreign Application Priority Data

Nov. 6, 1986 [GB] United Kingdom ..... 8626524
Jan. 23, 1987 [GB] United Kingdom ..... 8701488

[51] Int. Cl.[5] ..... A63B 53/02

[52] U.S. Cl. ..... 273/80.1; 273/80.2; 403/351; 403/353; 403/362

[58] Field of Search ..... 273/79, 80.1, 80.2, 273/80 C, 81 R; 403/351, 353, 360, 362

[56] References Cited

U.S. PATENT DOCUMENTS

| | | | |
|---|---|---|---|
| 1,665,811 | 4/1928 | Hadden | 273/80.8 X |
| 2,067,556 | 1/1937 | Wettlaufer | 273/79 X |
| 2,219,670 | 10/1940 | Wettlaufer | 273/79 |
| 2,425,808 | 8/1947 | Jakosky | 273/79 |
| 2,962,286 | 11/1960 | Brouwer | 273/79 |
| 3,176,987 | 4/1965 | Johnston | 273/80.2 X |
| 3,206,206 | 9/1965 | Santosuosso | 273/167.9 |
| 3,330,601 | 7/1967 | Proctor | 403/353 X |
| 3,601,399 | 8/1971 | Agens | 273/79 |
| 3,907,446 | 9/1975 | Leslie | 273/80.2 X |
| 3,984,103 | 10/1976 | Nix | 273/77 A |

FOREIGN PATENT DOCUMENTS

| | | |
|---|---|---|
| 1939371 | 2/1970 | Fed. Rep. of Germany . |
| 214466 | 4/1924 | United Kingdom . |
| 398721 | 9/1933 | United Kingdom . |
| 452305 | 8/1936 | United Kingdom . |
| 572116 | 9/1945 | United Kingdom . |
| 600549 | 4/1948 | United Kingdom . |
| 751323 | 6/1956 | United Kingdom . |
| 791496 | 3/1958 | United Kingdom . |
| 1271854 | 4/1972 | United Kingdom . |

*Primary Examiner*—Carl D. Price
*Attorney, Agent, or Firm*—Woodard, Emhart, Naughton, Moriarty & McNett

[57] ABSTRACT

A golf club tailored to the requirements of an individual player is assembled from the combination of a club head and a shaft assembly selected from a range of club heads and shaft assemblies having a variety of characteristics. In particular, the shaft assemblies each have a lower end portion defining an axis which is inclined with respect to an axis defined by the remainder of the shaft assembly. By allowing the lower portion of the shaft assembly to be fitted into a bore in the club head in a number of different rotational positions the lie and face angle of the head can be varied without exchanging club heads, thereby allowing a retail outlet to provide a wide choice of club characteristics without having to keep a large stock. The inclination of the lower end portion of the shaft assembly is achieved by fitting a tubular bush to the lower end of the shaft, the bush having a generally cylindrical outer surface for engaging the wall of the bore in the club head and defining a longitudinal axis which is inclined with respect to the axis of shaft. Means are provided for calibrating the rotational position of the bush in the club head to achieve a required face angle and lift combination. Once a suitable rotational position has been selected the shaft assembly is bonded in the head, with a pin passing through the shaft assembly and the head for additional anchorage.

13 Claims, 3 Drawing Sheets

GOLF CLUB

This application is a continuation of application Ser. No. 070,077, filed July 6, 1987, now abandoned.

BACKGROUND OF THE INVENTION

This invention relates to a golf club which has a shaft assembly connected to a head, the relative orientation of the head and the shaft assembly being chosen to give a desired trajectory characteristic for a given swing path and an individual player's characteristics.

It is known to construct a golf club from a shaft, usually made from steel, which is coaxial with an integral neck of a club head, and is glued and optionally pinned into the neck. To provide a secure fixture and to prevent the neck from splitting it is reinforced with whipping on a plastic, or other, sleeve. The weight and shape of the club head, and the angle of the shaft with respect to the club head amongst other features, determine the playing characteristics of the club. Relatively few clubs are "custom" made to suit individual players, and most are factory manufactured with the head permanently fixed to the shaft, allowing only a limited variation of the clubs to be produced and making it difficult for the individual to select a club to suit his or her precise needs. This also makes it necessary for a retail outlet to store a large and expensive range of stock to provide customers with a reasonable choice in performance and style of club.

It is an object of this invention to provide a club tailored to the needs of an individual player while at the same time making it possible for retail outlets to give customers a wide choice of club and to keep their stock to a reasonable size.

SUMMARY OF THE INVENTION

According to a first aspect of this invention, a golf club comprises a club head and a shaft assembly, the shaft assembly having a lower end portion mounted in the head, wherein the major portion of the shaft assembly defines a first longitudinal axis and the lower end porton defines a second longitudinal axis which is inclined with respect to the first longitudinal axis such that the orientation of the head with respect to the first longitudinal axis is dependent on the rotational position of the shaft assembly with respect to the head.

Preferably the lower end portion is a stub shaft and the axis thereof is inclined with respect to the axis of the shaft assembly by an angle less than or equal to 6°, and usually less than or equal to 4°.

In a preferred embodiment of the invention, the shaft assembly comprises a tubular metal or synthetic shaft having a grip at one end, and a bush is secured to the shaft at or adjacent, the other end of the shaft, the bush defining the said second longitudinal axis. The bush may be a plastics component moulded in situ on the shaft, or it may be a metal component bonded to the shaft. In either case it is preferably tubular, having a blind bore therein for receiving the shaft, and having an outer surface for engaging the sides of a bore in the club head, and having a recess to receive a pin for providing additional securing means between the shaft assembly and the club head. The outer surface defines an axis which is inclined with respect to the axis of the bore in the bush so that the bush may be received in the bore in the head in a number of different rotational positions to allow the head to have a number of different possible orientations with respect to the first longitudinal axis.

According to a second aspect of the invention, a method of assembling a golf club comprises providing a golf club head, providing a golf club shaft assembly having a major portion defining a first longitudinal axis and a lower end portion defining a second longitudinal axis inclined with respect to the first longitudinal axis, the lower end portion being shaped to be mounted to the club head in any of a plurality of rotational positions; mounting the said lower end portion to the club head at a selected one of the said positions to obtain a required orientation of the head with respect to the first longitudinal axis and fixing the lower end portion to the head at the said one position.

Preferably, the method includes applying an adhesive to at least one of the interengaging surfaces of the shaft assembly and the head prior to the mounting step thereby to fix the lower end portion to the head in the required rotational position.

The invention also includes a method of assembling a golf club comprising: providing a range of club heads having different characteristics; providing a range of shaft assemblies at least some of which each have a major portion defining a first longitudinal axis and a lower end portion defining a second longitudinal axis inclined with respect to the first longitudinal axis by a predetermined angle, different assemblies within the range having different angles between the said axes; selecting a club head from the range of club heads; selecting a shaft assembly having a required angle between the said axes; and securing the selected head to the selected shaft assembly with the head at a selected rotational position with respect to the shaft assembly so that the head is at a required angle with respect to the first longitudinal axis. The head may include a screw housed so as to be substantially parallel to the said second longitudinal axis when the shaft assembly is mounted to the head, and with the threaded portion of the screw positioned to engage the lower end portion. Further securing means between the club head and the shaft assembly may be provided by insering a pin through the club head into a recess in the lower end portion of the shaft.

A club constructed in accordance with the invention can be adjusted prior to final fixing of the club head to the shaft assembly. By altering the rotational position of the lower end portion of the shaft assembly in the head, the lie of the club can be adjusted between "upright" and "flat" limits and the face of the club can be adjusted between "open" and "closed" limits without requiring specialised equipment. In this way the customer can be provided with a club to suit his or her particular requirements at a substantially lower cost compared with a "tailor made" club built conventionally. The club may be constructed from a comparatively limited stock of parts at a place where limited skills and facilities are available, such as a retail outlet.

BRIEF DESCRIPTION OF THE DRAWINGS

The invention will be described below by way of example with reference to the drawings in which.

DESCRIPTION OF THE PREFERRED EMBODIMENT

Figure 1:
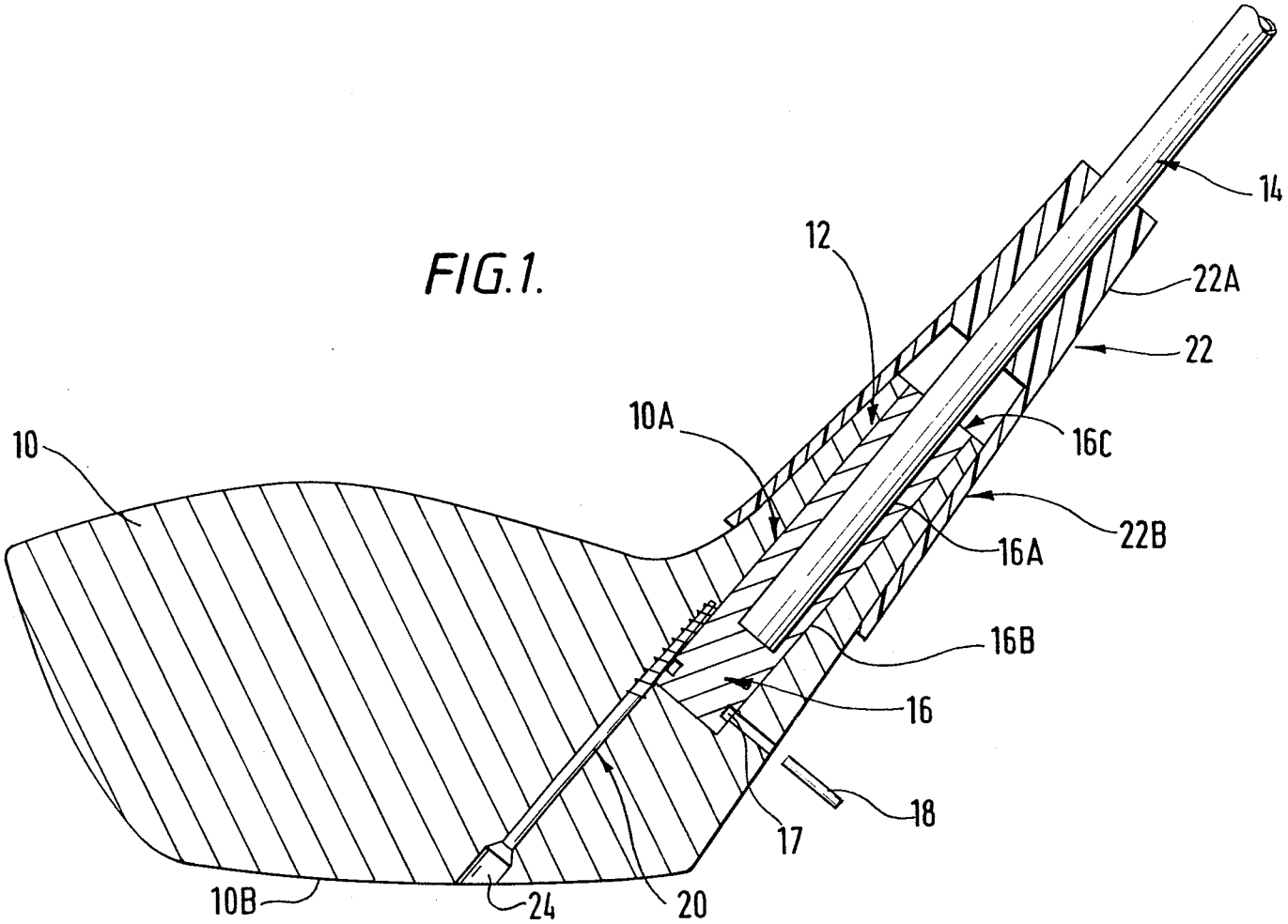
FIG. 1 is a cross-section through part of a golf club in accordance with the invention.

Referring to FIG. 1 of the drawings, a golf club in accordance with the invention comprises a club head 10 having a neck portion 12 which is drilled to receive the lower end portion of a shaft assembly including a shaft 14 and a bush 16. The shaft 14 forms a major portion of the shaft assembly and has at its upper end a grip (not shown). In this embodiment of the invention the shaft 14 is a straight metal tube defining a first longitudinal axis of the shaft assembly. In accordance with the invention, the bush 16 is shaped such the lower end portion of the assembly defines a second longitudinal axis by virtue of having a blind bore 16A for receiving the lower end of the shaft 14 and a substantially cylindrical outer surface 16B defining an axis inclined with respect to the bore 16A. When the bush 16 is fitted in the drilled bore 10A in the head 10, the axis of the shaft 14 is at an angle to the axis of the bore 10A in the head, the axes intersecting at a distance of less than or equal to 125 mm above the sole 10B of the head (along the axis of the shaft). It will be appreciated that the orientation of the head 10 with respect to the axis of the shaft 14 depends on the rotational position of the lower portion of the shaft assembly in the bore 10A. Thus, with a given shaft assembly with a predetermined angle between the first and second axes (referred to hereinafter as the "offset"), the club can be assembled to have a predetermined lie and face angle.

Typically, a retailer would be provided with a range of shaft assemblies having, on the one hand, different lengths, stiffnesses, flex-points and grips, and on the other hand, bushes with different offsets, e.g. 4°, 2° and 1°. The customer may then select a shaft assembly to suit his particular requirements, and match it with a club head selected from a range of different heads having a variety of characteristics (e.g. different lofts and weights), and, having a bore 10A at a selected angle for receiving the selected shaft assembly. If, for example, a shaft assembly with an offset of 2° is selected, and the bore in the head is at the "standard" shaft orientation specified down by the golfing authorities, the face angle and the lie can be varied by a maximum of + or −2° from standard, i.e. the face angle maybe at any angle between 2° open and 2° closed, and the lie can be selected to be at one of a range of values between 2° upright and 2° flat, according to the rotational position of the bush 16 when it is fitted into the bore 10A.

Alternatively, the bore 10A may be such that the mean lie or face angle deviates from the standard. For instance, a mean upright lie of 2° may be built into the head 10 in this manner. If, now, a shaft assembly with a 2° offset is mated with the head, the lift can be varied between 0° to 4° upright by appropriate selection of the rotational position of the head on the shaft assembly.

Figure 2:
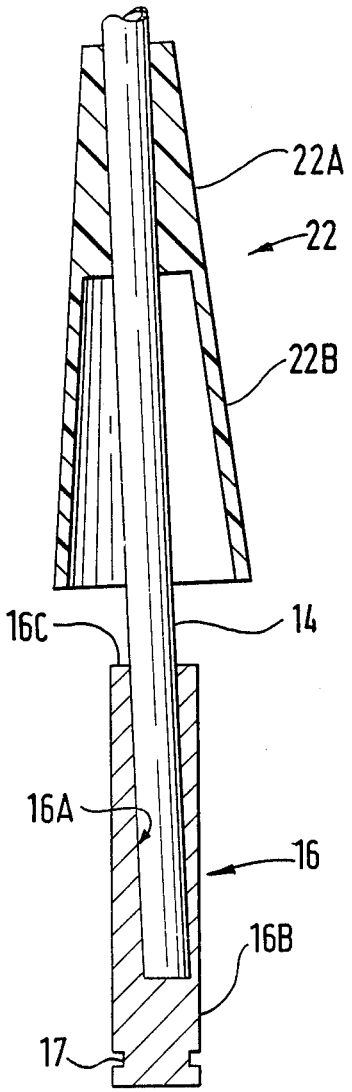
FIG. 2 is a partly cross-sectioned view of part of the shaft assembly of the club of FIG. 1.
Figure 3:
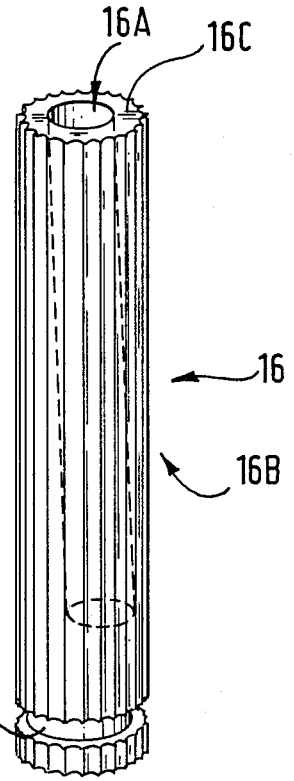
FIG. 3 is a diagrammatic perspective view of the bush forming part of the shaft assembly of FIG. 2.
Figure 4:
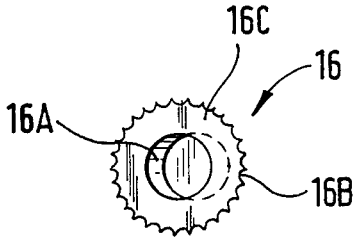
FIG. 4 is a diagrammatic top view of the bush.

Turning now to the constructional details of the preferred embodiment, the bush 16 is a machined aluminium alloy component having, as shown in FIGS. 2, 3 and 4, a blind bore 16A drilled at an angle (the "offset") to its generally cylindrical outer surface 16B. The bore 16A may be provided with splines or other longitudinal discontinuities (not shown) to assist in anchoring the bush 16 to the shaft 14, or the bush may have a grub screw bearing transversely on the shaft. These are just two methods of fixing the bush to the shaft, in addition to use of an adhesive. The outer surface 16B of the bush 16 has surface discontiniuties in the form of fluting or splines as shown in FIG. 3 and 4 to assist in the location of the bush in the bore 10A in the head by engagement with a surface discontinuity in the bore 10A, in this case a screw 20 (shown in FIG. 1) housed parallel to the axis of the bore 10A with its thread just protruding into the bore. Also the outer surface 16B of the bush 16 contains a recess 17, approximately 3 mm deep and 3 mm wide, cut into the lower part of the bush 16 about 3 mm from the end of the bush. Having selected a shaft assembly and head, the retailer coats the splined surface of the bush 16 with a releasable adhesive and slides the assembly into the bore 10A at a selected rotational position. The splines can be used as calibration marks for selecting the rotational position. The screw 20 is inserted to engage one of the splines and then tightened to apply a longitudinal anchoring force to the shaft assembly. This provides additional resistance to tension and torsional forces. Further securing means against forces in the longitudinal axis is provided by inserting a plain metal pin 18 through a hole, which passes through the club head 10 into the bore 10A, and into the recess 17 in the lower part of the bush, which is filled with adhesive.

Prior to application of the adhesive to fix the bush 16 in the bore 10A, the orientation of the head 10 on the shaft assembly may be changed a number of times to allow trial of different lies and face angles, and indeed, to allow the customer to try different combinations of head and shaft assembly. Once the adhesive has been used, however, the position of the head is set, and can only be changed by the use of specialist/manufacturing facilities, and the use of specialised tools to remove the neckpin.

The dimensions of the bush 16 and the bore 10A are such that, when the bush is pushed fully home, the top surface 16C of the bush is flush with the end of the neck portion 12. To cover the joint between the bush and the head, a hosel 22 (FIGS. 1 and 2), having a collar portion 22A and a sheath portion 22B, is slid from the shaft 14 to cover the neck portion 12 as shown in FIG. 1. This hosel is preferably made from a flexible hydrocarbon polymer such as ABS or urethane.

Since the bush 16 is completely contained in the neck portion 12 of the head 10, the external appearance of the preferred embodiment does not reveal the existence or nature of the inclination of the head on the shaft assembly, and with the hosel 22 in position the finished club has a similar appearance to the conventional club, there being a natural transition between the hosel 22 and the outer surface of the head 10. The head of the screw 20 is covered by a plug 24 inserted and bonded into the screw hole in the sole of the head.

Figure 5:
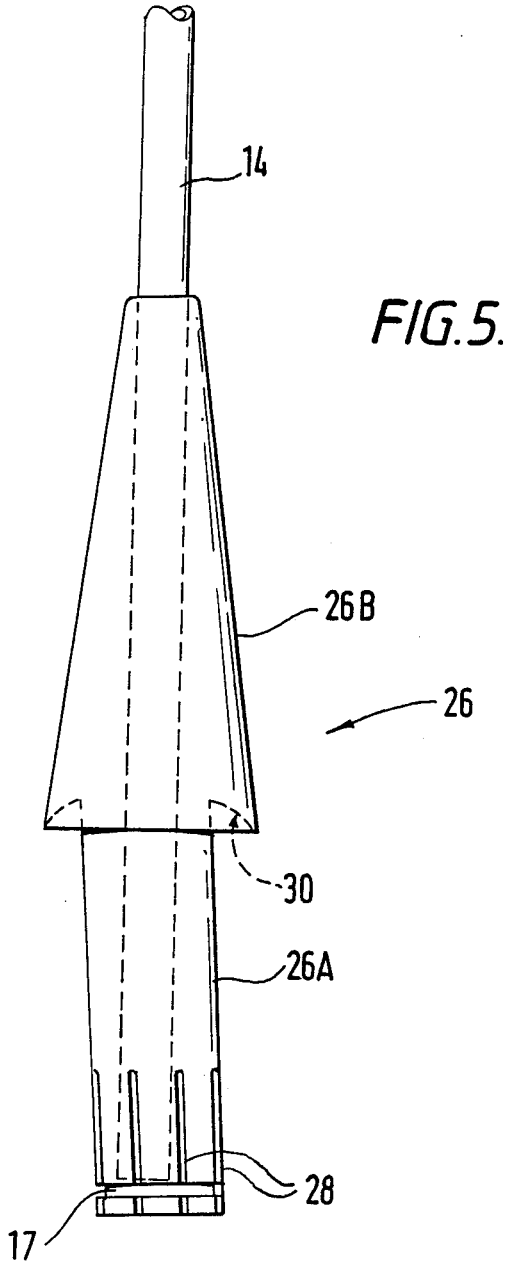
FIG. 5 is a side elevation of part of an alternative shaft assembly.

An alternative shaft assembly is shown in part in FIG. 5. This assembly has a combined bush and hosel component 26 which may be constructed from plastics material. Preferably, the component 26 is moulded in situ on the shaft 14, key means on the shaft 14 providing increased torsional strength. As before, the bush part 26A of the component has a cylindrical outer surface defining an axis inclined with respect to the axis of the shaft 14 to yield the required offset. In this case the bush part 26A has eight longitudinal grooves 28 for location with respect to the screw 20 (FIG. 1), however the bush still contains the recess 17 to receive the pin 18. The hosel part 26B forms a continuation of the neck portion 12 of the head 10 (FIG. 1) to continue the taper of the neck portion 12 down virtually to the diameter of the shaft 14. Preferably the neck portion 12 has a hemi-spherical end which is received by a correspondingly shaped concave surface 30 of the hosel part 26B, to allow close abutment of the hosel part with the neck portion regardless of the rotational position of the bush 26A in the head 10.

A further alternative shaft assembly, not shown in the drawings, comprises a shaft having a lower end portion which is bent to the required offset angle, the bend being located so as to be immediately above the end of the neck portion of the head when the club is assembled.

The screw 20 shown in FIG. 1 may be replaced by a bolt threaded coaxially from beneath into the lower end of the bush 16 and/or the shaft 14, the head of the bolt being recessed into the sole of the club head. A serrated lock washer may be placed beneath the bolt head. This fixing technique is particularly appropriate for metal or plastics "woods".

What is claimed is:

1. A golf club comprising a club head, a shaft assembly, the shaft assembly having a generally cylindrical lower end portion mounted in a round bore defined in said club head, wherein a major portion of the shaft assembly defines a first longitudinal axis and the lower end portion defines a second longitudinal axis which is inclined with respect to the first longitudinal axis such that the orientation of the head with respect to the first longitudinal axis is dependent on the rotational position of the shaft assembly with respect to the head, first means operable for securing said club head and shaft assembly temporarily in any relative orientation, and second means operable for securing said club head and shaft assembly permanently in a selected relative orientation, said shaft assembly comprising a shaft having a grip at one end thereof and a bush secured to the shaft at the other end thereof, the bush alone defining the second longitudinal axis, said bush including a sleeve having a longitudinal bore housing said other end of the shaft and said bush having an outer surface engaging said bore in the head, the outer surface defining an axis which is inclined with respect to the axis of the bore in the sleeve.

2. A method of assembling a golf club comprising:

providing a range of club heads having different characteristics but each having a round bore;

providing a range of shaft assemblies at least some of which each have a major portion defining a first longitudinal axis and a generally cylindrical lower end portion defining a second longitudinal axis inclined with respect to the first longitudinal axis by a predetermined angle, different assemblies within the range having different angles between the said axes;

selecting a club head from the range of club heads;

selecting a shaft assembly having a required angle between the said axes;

securing the selected head to the selected shaft assembly by inserting the cylindrical lower end portion in said round bore of the selected club head and adjusting to a desired rotational position with respect to the shaft assembly so that the head is at a required angle with respect to the first longitudinal axis while the shaft assembly and club head are temporarily secured together; and permanently securing the selected club head and shaft assembly together at said desired rotational position;

3. A kit of parts for assembling a golf club comprising a club head, an elongate shaft having a longitudinal axis, and a straight cylindrical bush of round cross-section, in which there is a bore in the club head to receive one end of the shaft and the diameter of said bore in the club head is greater than the diameter of said one end of the shaft, the cylindrical bush has a bore to receive said one end of the shaft and with its outer surface engages said bore in the club head to locate said one end of the shaft in the bore in the club head, said bore in the bush having an axis, and said outer surface of the bush defining an axis, wherein said axis defined by the outer surface of the bush lies at an angle with respect to said axis of the bore in the bush and hence the longitudinal axis of the shaft, means is provided to attach the bush permanently to the shaft, first means is provided for releasably holding the bush to the club head whereby the desired position of rotation of the bush in said bore in the club head, and hence the lie and face angle of the assembled club, may be ascertained, and second and permanent connection means is provided for fixing the bush in its selected rotational position in said bore of the club head for use of the club.

4. A kit of parts according to claim 3 in which there is provided a selection of different club heads, and a selection of different shaft assemblies comprising different shafts with bushes attached thereto having different angles of inclination between said axes defined by their respective outer surfaces and said axes of their respective bores.

5. A golf club of the kind comprising a club head, an elongate shaft having a longitudinal axis, and a bore in the club head to receive one end of the shaft, in which the diameter of said bore in the club head is greater than the diameter of said one end of the shaft and there is a straight cylindrical bush of round cross section for locating said one end of the shaft in the bore in the club head, which bush has a bore to receive said one end of the shaft and an outer surface to engage said bore in the club head, said bore in the bush having an axis, and said outer surface of the bush defining an axis, wherein said axis defined by the outer surface of the bush lies at an angle with respect to said axis of the bore in the bush and hence the longitudinal axis of the shaft, there being further provided means to attach the bush permanently to the shaft, first means for releasably holding the bush to the club head whereby the desired position of rotation of the bush in said bore in the club head, and hence the lie and face angle of the assembled club, may be ascertained, and second and permanent connection means for fixing the bush in its selected rotational position in said bore of the club head for use of the club.

6. A golf club according to claim 5, wherein the outer surface of the bush includes means for locating the bush in said bore of the club head at a required rotational position.

7. A golf club according to claim 6, wherein said locating means comprises a plurality of surface discontinuities extending parallel to said axis defined by the outer surface of the bush for engagement with at least one corresponding surface discontinuity in said bore of the club head.

8. A golf club according to claim 5, wherein said axis defined by the outer surface of the bush is inclined with respect to the longitudinal axis of the shaft by an angle of less than or equal to 6°.

9. A golf club according to claim 8 wherein the said angle is less than or equal to 4°.

10. A golf club according to claim 5, wherein said first means for releasably holding the bush to the club head comprises a securing screw housed in the club head and engaging said outer surface of the bush.

11. A golf club according to claim 10, wherein the securing screw is arranged with its axis substantially parallel to said axis defined by the outer surface of the bush.

12. A golf club according to claim 5, wherein said axis defined by the outer surface of the bush and the longitudinal axis of the shaft intersect at a point less than about 125 mm from the sole of the club head.

13. A golf club according to claim 5, wherein said second and permanent connection means for fixing the bush in said bore of the club head includes a pin which is insertable in a hole in the club head to engage a groove on said outer surface of the bush.

* * * * *